US009159314B2

(12) United States Patent
Osowski et al.

(10) Patent No.: US 9,159,314 B2
(45) Date of Patent: Oct. 13, 2015

(54) DISTRIBUTED SPEECH UNIT INVENTORY FOR TTS SYSTEMS

(71) Applicant: IVONA Software Sp. z.o.o., Gdynia (PL)

(72) Inventors: Lukasz M. Osowski, Gdynia (PL); Michal T. Kaszczuk, Gdynia (PL)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 299 days.

(21) Appl. No.: 13/740,762

(22) Filed: Jan. 14, 2013

(65) Prior Publication Data

US 2014/0200894 A1 Jul. 17, 2014

(51) Int. Cl.

*G10L 13/08* (2013.01)
*G10L 13/04* (2013.01)
*G10L 13/047* (2013.01)

(52) U.S. Cl.

CPC ..... *G10L 13/08* (2013.01); *G10L 13/04* (2013.01); *G10L 13/047* (2013.01)

(58) Field of Classification Search

CPC ..... G10L 13/08
USPC ..... 704/260
See application file for complete search history.

(56) References Cited

U.S. PATENT DOCUMENTS 8,086,457 B2 * 12/2011 Campbell et al. ..... 704/260
8,125,485 B2 * 2/2012 Brown et al. ..... 345/473
8,311,837 B1 * 11/2012 Fox ..... 704/270.1
8,321,222 B2 * 11/2012 Pollet et al. ..... 704/260
8,321,223 B2 * 11/2012 Meng et al. ..... 704/260
8,380,508 B2 * 2/2013 Plumpe ..... 704/260
8,509,403 B2 * 8/2013 Chiu et al. ..... 379/114.13
8,719,006 B2 * 5/2014 Bellegarda ..... 704/9
8,959,021 B2 * 2/2015 Kaszczuk et al. ..... 704/260
2009/0299746 A1 12/2009 Meng

FOREIGN PATENT DOCUMENTS

EP 1471499 A1 10/2004
WO 2006128480 A1 12/2006

OTHER PUBLICATIONS

International Search Report of PCT/IB2014/000535, Mailed Oct. 25, 2014, Applicant: Ivona Software SP. Z.O.O., 5 pages.

* cited by examiner

*Primary Examiner* — Susan McFadden
(74) *Attorney, Agent, or Firm* — Seyfarth Shaw LLP; Ilan N. Barzilay

(57) ABSTRACT

In a text-to-speech (TTS) system, a database including sample speech units for unit selection may be configured for use by a local device. The local unit database may be created from a more comprehensive unit database. The local unit database may include units which provide sufficient TTS results for frequently input text. Speech synthesis may then be performed by concatenating locally available units with units from a remote device including the comprehensive unit database. Aspects of the speech synthesis may be performed by the remote device and/or the local device.

25 Claims, 5 Drawing Sheets

DISTRIBUTED SPEECH UNIT INVENTORY FOR TTS SYSTEMS

BACKGROUND

Human-computer interactions have progressed to the point where computing devices can render spoken language output to users based on textual sources. In such text-to-speech (TTS) systems, a device converts text into an audio waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

In distributed text-to-speech (TTS) systems a powerful centralized server may perform TTS processing using a large unit database to produce high-quality results. Local devices send text to the centralized TTS device/server where the text is processed into audio waveforms including speech. The waveforms, or other representations of the audio data, are then sent to the local devices for playback to users. One drawback to such a distributed TTS system is that many local devices relying on a centralized server for TTS processing may result in a large network load transferring audio data from the server to the local devices, as well as a large workload for the server performing TTS processing for each local device. Latency between the central server and local device may also result in delays returning TTS results to a user. Further, if a network connection between a local device and remote device is unavailable, TTS processing may be prevented.

Offered is a system and method to perform certain TTS processing on local devices. A local device may be configured with a smaller version, or subset, of the central large unit database. A local device may then perform localized TTS processing using the local unit database. Although the smaller local unit database may not provide the same high quality results across a broad range of text as a much larger unit database available on a remote server, the local unit database may be configured to provide high quality results for a portion of frequently encountered text while being significantly smaller in terms of resource allocation, particularly storage. When a local device performs TTS processing it first checks the local unit database to see if the units for speech synthesis are available locally. If so, the local database performs TTS processing locally. If certain units are unavailable locally, the local device may communicate with a remote TTS device, such as a centralized server, to obtain those units to complete the speech synthesis. In this manner a portion of speech synthesis processing may be offloaded to local devices, thereby decreasing bandwidth usage for TTS communications between local devices and a server, as well as decreasing server load.

Figure 1:
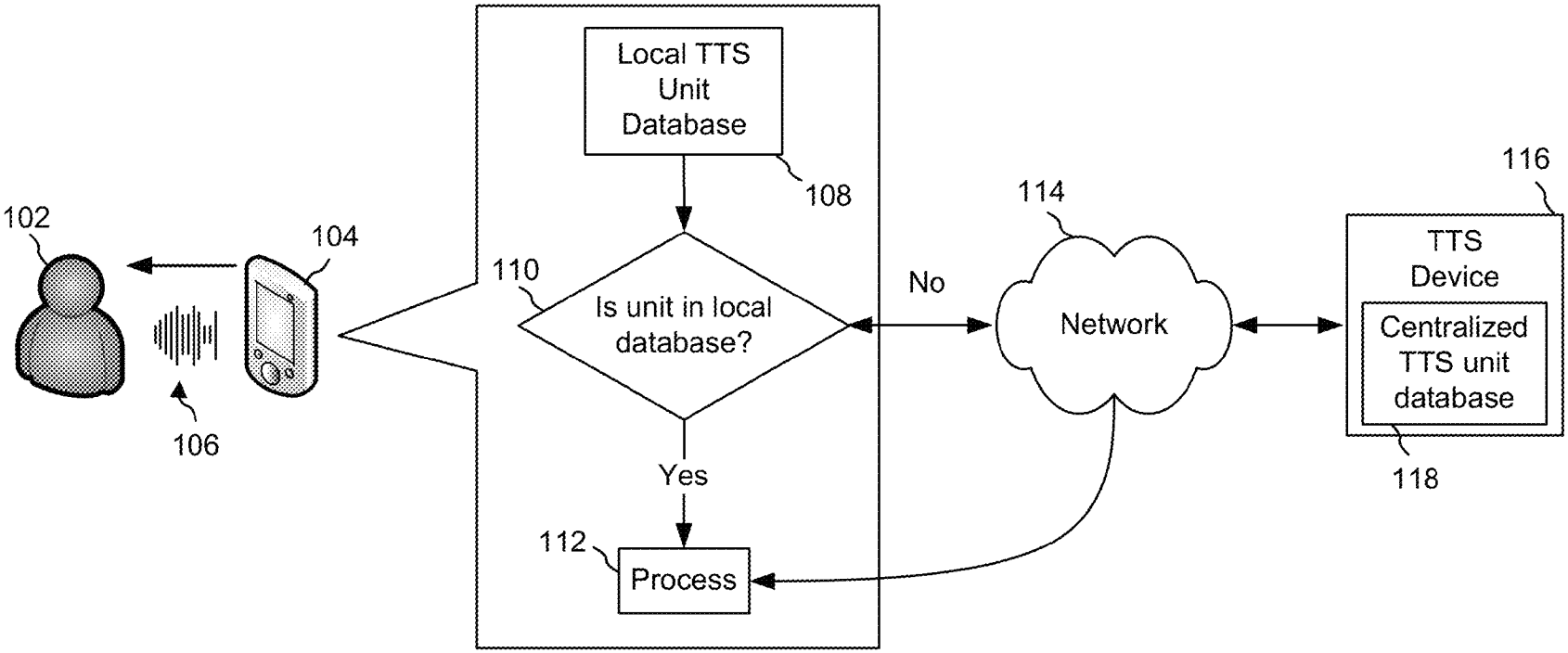
FIG. 1 illustrates a local speech unit inventory for TTS systems according to one aspect of the present disclosure.

An example of a localized TTS unit database according to one aspect of the present disclosure is shown in FIG. 1. A local device 104 provides TTS results to a user 102 in the form of speech 106. The textual source of the speech is not shown. Under normal operating conditions, the local device 104 sends the text to remote TTS device 116, which includes a large centralized unit database 118, over the network 114. The TTS results are then provided to the local device 104 from the remote TTS device 116 over the network 114. As shown in FIG. 1, the local device 104 may be configured with a local TTS unit database 108. The local TTS unit database 108 may be used to provide TTS results. When the text is received by the local device 104 for TTS processing, the local device checks to see if the local unit database 108 includes the units to perform speech synthesis for the input text, as shown in block 110. If the units are available locally, the local device 104 performs TTS processing, as shown in block 112. If the units are not available locally, the local device contacts the remote device 116 over the network 114. The remote device 116 then sends the units to the local device 104 which completes the speech synthesis using the units obtained from the remote device 116. In another aspect the text may be sent directly to the remote device 116 which may then perform the check 110 to see if the local unit database 108 includes the units to perform speech synthesis for the input text. The remote device 116 may then send the local device 104 the unit sequence from the text along with any units not stored in the local TTS unit database 108 and instructions to concatenate the locally available units with the received units to complete the speech synthesis.

Figure 2:
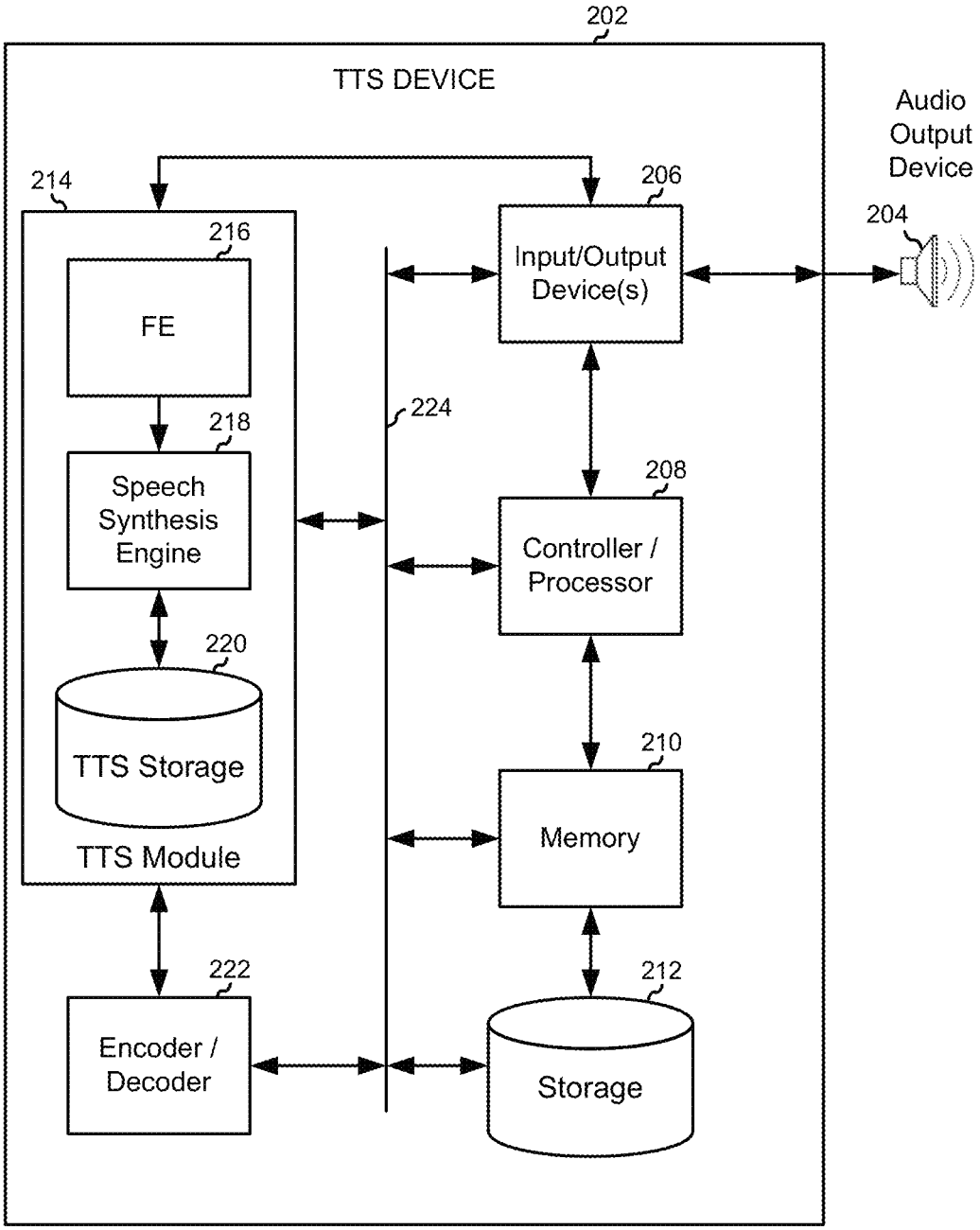
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input/output devices 206 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech synthesis functionality such as automated teller machines (ATMs), kiosks, global positioning systems (GPS), home appliances (such as refrigerators, ovens, etc.), vehicles (such as cars, busses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphones, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The controller/processor 208 may include a digital signal processor for generating audio data corresponding to speech. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input/output device 206. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input/output device(s) 206. A variety of input/output device(s) may be included in the device. Example input devices include a microphone, a touch input device, keyboard, mouse, stylus or other input device. Example output devices, such as an audio output device 204 (pictured as a separate component) include a speaker, visual display, tactile display, headphones, printer or other output device. The input/output device 206 may also include an interface for an external peripheral device connection such as universal serial bus (USB), FireWire, Thunderbolt or other connection protocol. The input/output device 206 may also include a network connection such as an Ethernet port, modem, etc. The input/output device 206 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input/output device 206 the TTS device 202 may connect to a network, such as the Internet or private network, which may include a distributed computing environment.

The device may also include a TTS module 214 for processing textual data into audio waveforms including speech. The TTS module 214 may be connected to the bus 224, input/output device(s) 206, audio output device 204, encoder/decoder 222, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud. Textual data may be processed in real time or may be saved and processed at a later time.

The TTS module 214 includes a TTS front end (FE) 216, a speech synthesis engine 218 and TTS storage 220. The FE 216 transforms input text data into a symbolic linguistic representation for processing by the speech synthesis engine 218. The speech synthesis engine 218 compares the annotated speech units in the symbolic linguistic representation to models and information stored in the TTS storage 220 for converting the input text into speech. Speech units include symbolic representations of sound units to be eventually combined and output by the TTS device 202 as speech. Various sound units may be used for dividing text for purposes of speech synthesis. For example, speech units may include phonemes (individual sounds), half-phonemes, di-phones (the last half of one phoneme coupled with the first half of the adjacent phoneme), bi-phones (two consecutive phonemes), syllables, words, phrases, sentences, or other units. A TTS module 214 may be configured to process speech based on various configurations of speech units. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within another component or external device.

Text input into a TTS module 214 may be sent to the FE 216 for processing. The front-end may include modules for performing text normalization, linguistic analysis, and prosody generation. During text normalization, the FE processes the text input and generates standard text, converting such things as numbers, abbreviations (such as Apt., St., etc.), symbols ($, %, etc.) and other non-standard text into the equivalent of written out words.

During linguistic analysis the FE 216 analyzes the language in the normalized text to generate a sequence of speech units corresponding to the input text. This process may be referred to as phonetic transcription. Each word of the normalized text may be mapped to one or more speech units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform prosody generation where the speech units are annotated with desired prosodic characteristics, also called acoustic features, which indicate how the desired speech units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific speech units are to be pronounced in certain circumstances. A prosodic model may consider, for example, a phoneme's position in a syllable, a syllable's position in a word, a word's position in a sentence or phrase, neighboring speech units, etc. As with the language dictionary, prosodic models with more information may result in higher quality speech output than prosodic models with less information.

The output of the FE 216, referred to as a symbolic linguistic representation, may include a sequence of speech units annotated with prosodic characteristics. This symbolic linguistic representation may be sent to a speech synthesis engine 218, also known as a synthesizer, for conversion into an audio waveform of speech for eventual output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a database of recorded speech is matched against the symbolic linguistic representation created by the FE 216. The speech synthesis engine 218 matches the symbolic linguistic representation against spoken audio units in the database. Matching units are selected and concatenated together to form a speech output. Each unit includes an audio waveform corresponding with a speech unit, such as a short waveform of the specific sound, along with a description of the various acoustic features associated with the waveform (such as its pitch, energy, etc.), as well as other information, such as where the speech unit appears in a word, sentence, or phrase, the neighboring speech units, etc. Using all the information in the unit database, the speech synthesis engine 218 may match units to the input text to create a natural sounding waveform. The unit database may include multiple examples of speech units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis, also described further below, parameters such as frequency, volume, noise, are varied by a digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the speech synthesis engine 218 to assign specific audio waveform parameters to input speech units and/or prosodic annotations. The rules may be used to calculate a score representing a likelihood that a particular audio output parameter(s) (such as frequency, volume, etc.) corresponds to the portion of the input symbolic linguistic representation from the FE 216.

The speech synthesis engine 218 may use a number of techniques to match speech to be synthesized with input speech units and/or prosodic annotations. One common technique is using Hidden Markov Models (HMMs). HMMs may be used to determine probabilities that audio output should match textual input. Using HMMs, a number of states are presented, in which the states together represent one or more potential acoustic parameters to be output and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their features (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text.

Figure 3:
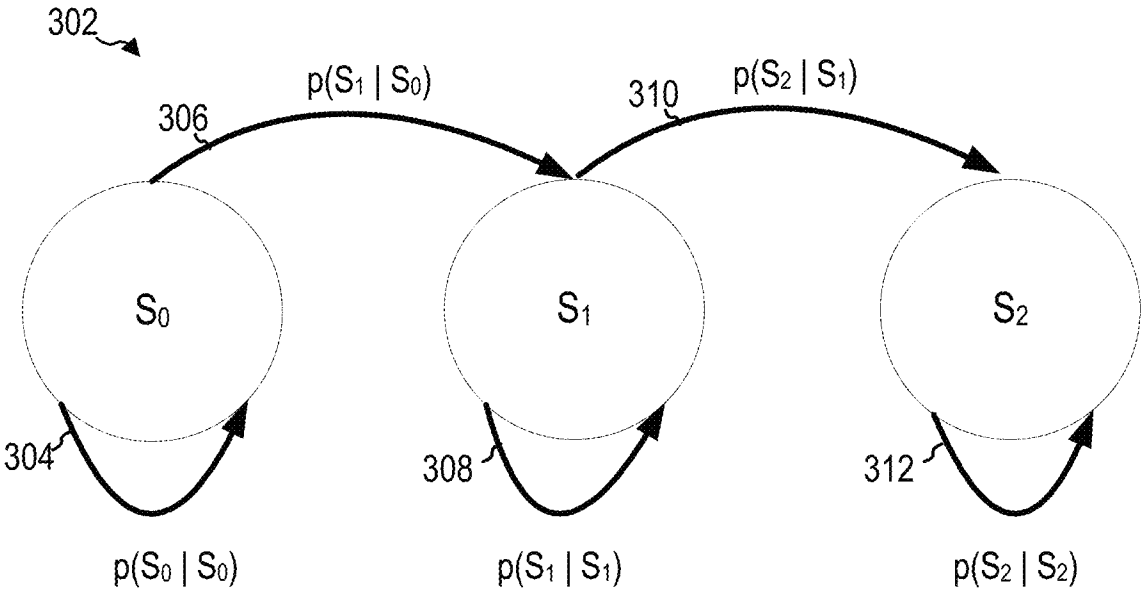
FIG. 3 illustrates speech synthesis using a Hidden Markov Model according to one aspect of the present disclosure.

An example of HMM processing for speech synthesis is shown in FIG. 3. A sample input speech unit, for example, phoneme /E/, may be processed by a speech synthesis engine 218. The speech synthesis engine 218 may initially assign a probability that the proper audio output associated with that phoneme is represented by state S0 in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as P(S0|S0), meaning the probability of going from state S0 to S0) and how well the subsequent frame matches states S0 and S1. If state S1 is the most probable, the calculations move to state S1 and continue from there. For subsequent speech units, the speech synthesis engine 218 similarly determines whether the state should remain at S1, using the transition probability represented by $P(S_1|S_1)$ 308, or move to the next state, using the transition probability $P(S_2|S_1)$ 310. As the processing continues, the speech synthesis engine 218 continues calculating such probabilities including the probability 312 of remaining in state $S_2$ or the probability of moving from a state of illustrated phoneme /E/ to a state of another phoneme. After processing the speech units and acoustic features for state $S_2$, the speech recognition may move to the next speech unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of parameter states.

In addition to calculating potential states for one audio waveform as a potential match to a speech unit, the speech synthesis engine 218 may also calculate potential states for other potential audio outputs (such as various ways of pronouncing phoneme /E/) as potential acoustic matches for the speech unit. In this manner multiple states and state transition probabilities may be calculated.

The probable states and probable state transitions calculated by the speech synthesis engine 218 may lead to a number of potential audio output sequences. Based on the acoustic model and other potential models, the potential audio output sequences may be scored according to a confidence level of the speech synthesis engine 218. The highest scoring audio output sequence may be chosen and digital signal processing may be used to create an audio output including synthesized speech waveforms.

Unit selection speech synthesis may be performed as follows. Unit selection includes a two-step process. First a speech synthesis engine 218 determines what speech units to use and then it combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may work for a particular speech segment. For example, a target cost indicates how well a given speech unit matches the features of a desired speech output (e.g., pitch, prosody, etc.). A join cost represents how well a speech unit matches a consecutive speech unit for purposes of concatenating the speech units together in the eventual synthesized speech. The overall cost function is a combination of target cost, join cost, and other costs that may be determined by the speech synthesis engine 218. As part of unit selection, the speech synthesis engine 218 chooses the speech unit with the lowest overall cost. For example, a speech unit with a very low target cost may not necessarily be selected if its join cost is high.

A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by speech unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both speech units and prosodic annotations). Generally the larger the speech unit database the better the speech synthesis may be achieved by virtue of the greater number of unit samples that may be selected to form the precise desired speech output. Multiple selected units may then be combined together to form an output audio waveform representing the speech of the input text.

Audio waveforms including the speech output from the TTS module 214 may be sent to an audio output device 204 for playback to a user or may be sent to the input/output device 206 for transmission to another device, such as another TTS device 202, for further processing or output to a user. Audio waveforms including the speech may be sent in a number of different formats such as a series of feature vectors, uncompressed audio data, or compressed audio data. For example, audio speech output may be encoded and/or compressed by the encoder/decoder 222 prior to transmission. The encoder/decoder 222 may be customized for encoding and decoding speech data, such as digitized audio data, feature vectors, etc. The encoder/decoder 222 may also encode non-TTS data of the TTS device 202, for example using a general encoding scheme such as .zip, etc. The functionality of the encoder/decoder 222 may be located in a separate component, as illustrated in FIG. 2, or may be executed by the controller/processor 208, TTS module 214, or other component, for example.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 4:
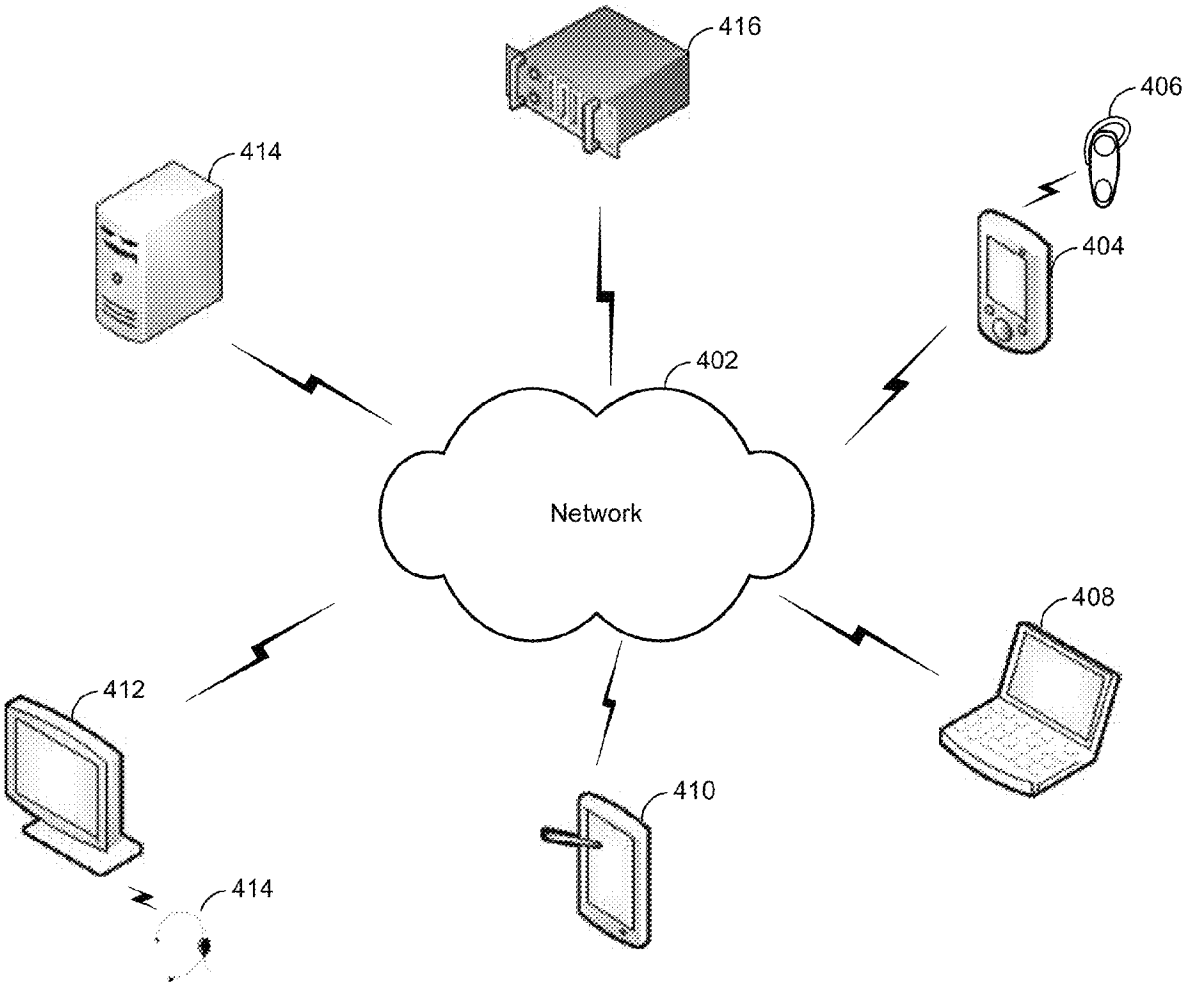
FIG. 4 illustrates a computer network for use with text-to-speech processing according to one aspect of the present disclosure.

Multiple TTS devices 202 may be connected over a network. As shown in FIG. 4 multiple devices may be connected over network 402. Network 402 may include a local or private network or may include a wide network such as the internet. Devices may be connected to the network 402 through either wired or wireless connections. For example, a wireless device 404 may be connected to the network 402 through a wireless service provider. Other devices, such as computer 412, may connect to the network 402 through a wired connection. Other devices, such as laptop 408 or tablet computer 410 may be capable of connection to the network 402 using various connection methods including through a wireless service provider, over a WiFi connection, or the like. Networked devices may output synthesized speech through a number of audio output devices including through headsets 406 or 414. Audio output devices may be connected to networked devices either through a wired or wireless connection. Networked devices may also include embedded audio output devices, such as an internal speaker in laptop 408, wireless device 404 or table computer 410.

In certain TTS system configurations, a combination of devices may be used. For example, one device may receive text, another device may process text into speech, and still another device may output the speech to a user. For example, text may be received by a wireless device 404 and sent to a computer 414 or server 416 for TTS processing. The resulting speech audio data may be returned to the wireless device 404 for output through headset 406. Or computer 412 may partially process the text before sending it over the network 402. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

One benefit to such distributed TTS systems is the capability to produce high quality TTS results without dedicating an overly large portion of mobile device resources to TTS processing. By centralizing TTS resources, such as linguistic dictionaries, unit selection databases and powerful processors, a TTS system may deliver fast, desirable results to many devices. One drawback, however, to such distributed TTS systems is that a centralized server performing TTS processing for multiple local devices may experience significant load and the overall system may use a significant amount of bandwidth transmitting TTS results, which may include large audio files, to multiple devices.

To push certain TTS processing from a central server to remote devices, a smaller localized TTS unit selection database may be provided on a local device for use in unit selection TTS processing. The local unit selection database may be configured with units capable of performing quality TTS processing for frequently encountered text. As testing reveals that a small portion of a large TTS unit database (for example, 10-20% of units) is used for a majority of TTS processing (for example, 80-90%), a smaller local TTS unit database may provide sufficient quality results for most user experience without use of a distributed TTS system and without expending the same amount of storage resources that might be expended for a complete, much larger TTS database. Further, local TTS unit databases may result in a lower network traffic load to a centralized server, as much of the TTS processing may be performed by local devices. Also, delays that might otherwise be seen from communications between a local device and a remote device may be reduced.

In one aspect, local TTS processing may also be combined with distributed TTS processing. Where a portion of text to be converted uses units available in a local database, that portion of text may be processed locally. Where a portion of text to be converted uses units not available in a local database, the local device may obtain the units from a remote device. The units from the remote device may then concatenated with the local units for construction of the audio speech for output to a user. In this aspect, the local device may be configured with a list of units and their corresponding acoustic features that are available at a remote TTS device.

In another aspect, selection of units from input text may be performed by a remote device where the remote device is aware of what units are available on a local device. The remote device may determine the desired units to use in synthesizing the text and send the local device the unit sequence, along with the unit speech segments that are unavailable on the local device. The local device may then take the unit speech segments sent to it by the remote device, along with the unit speech segments that are available locally, and perform unit concatenation and complete the speech synthesis based on those unit segments and the unit sequence sent from the remote device.

In one aspect a local unit database may be configured in a local device in a single instance. In another aspect, a local unit database may be configured dynamically. For example, an existing local unit database may be adjusted to include multiple examples of frequently used speech units. Less frequently used units may be removed from the database when others are added, or the database size may grow or shrink depending on device configuration. In another aspect a local unit database may not be pre-configured but may be built from the ground up. For example, a local device may construct the unit database in a cache model, where the local device or remote device keeps track of frequently used speech units by a local device. The remote device may then send the local device those frequently used speech units to populate the unit database up to some configured size limit. In this aspect, a local device may begin with few (or no) units in the local database, but the database may be built as the local device is asked to perform TTS processing (with the assistance of a remote device).

The local device may be configured to adjust the local unit database based on a variety of factors such as available local storage, network connection quality, bandwidth used in communicating with the network, frequency of TTS requests, desired TTS quality or domain of use (e.g. navigation), etc. In another aspect a subset of a centralized remote unit database may be sent to a local device based on an anticipated TTS domain of use. For example, if TTS for navigation is anticipated, a subset of units common for navigation TTS may be requested by/pushed to a local device.

The local unit database may also be configured based on a user of the device. Such configuration may be based on user input preferences or on user behavior in interacting with the TTS device. For example, a device may determine that a visually impaired user is relying on the TTS device based on frequency of TTS requests, breaks in speech synthesis, higher TTS speech rate, length of text to be read aloud, etc. If a local device is providing TTS for a user with such accessibility issues, the local device may be configured to provide faster TTS output, which may in turn result in a larger number of units being stored in the local unit database which in turn may result in faster speech synthesis. In another aspect, a local unit database may be adjusted to include speech units used frequently by a particular user. A local device or remote device may keep track of used speech units by user and may configure a local database to include frequently used speech units as desired.

In another aspect, the local device may cache a certain local unit database configured for a particular application, and then delete that cache once the application processes are completed. In another aspect, the local device may clear a unit database cache once a session is completed. In another aspect, a certain portion of a local unit database may be defined, with a remainder of the database to be configured dynamically. The dynamically configured portion may be treated as a cache and then deleted when the device has completed an application session. The defined portion of the database may then remain for future use. The various methods of configuring and maintaining the local unit database may be performed by the system or may be based on user preferences. The above, and other, aspects may also be combined based on desired device operation.

In another aspect, different local unit databases may be configured and available for storage onto a local device. The different local unit databases may be configured for different TTS applications (such as GPS, e-reader, weather, etc.), speech personalities (such as specific celebrity or configurable voices), or other special characteristics. In another aspect, a local device may be configured with multiple unit databases for multiple languages. Because the individual unit databases are relatively small compared with a comprehensive unit database, a mobile device configured with unit databases for multiple languages may be able to provide a sufficient quality level of TTS processing for many languages.

As noted above, the size of a unit database is variable, and ultimately may be a result of a design choice between resource (i.e., storage or bandwidth) consumption and desired TTS quality. The choice may be configured by a device manufacturer, application designer, or user.

To create a local unit database pruning techniques may be used. Using pruning techniques, a large centralized unit database may be reduced in size to create a smaller local unit database at a desired size and TTS quality setting. In one aspect of the present disclosure, pruning may be performed as follows. In order to provide a desired list of speech unit candidates across a general category of contexts, each unit in an optimal centralized unit database may be repeated many times within the database under various speaking conditions. This allows the creation of high-quality voices during speech synthesis. To reduce such a large unit database, pruning techniques may be used to reduce the database size while reducing the impact on the speech quality.

To prune a large unit database to arrive at a sample local unit database, the large unit database may be analyzed to identify unique contexts of units in the database. Then, for each class of contexts a unit representative is selected with a goal of improving database integrity, meaning maintaining at least some ability to process a wide variety of incoming text. Speech units which are used in multiple phonemes/words may also be prioritized for selection in the local database. This technique may also be used to modify existing local unit databases, as well as create new ones.

Although a local unit database may focus on being able to produce quality TTS results for frequently input text, the local database may also be configured with units capable of at least one example for each known speech unit (e.g., diphone). With even those limited unit examples a local device may provide comprehensive TTS results, even if certain portions of those results (which rely on the limited unit examples) may be lower in quality than others (which rely on multiple unit examples). If a local unit database includes at least one example for each speech unit, the local device may be capable of unit selection speech synthesis (if perhaps of reduced quality) even in situations where access to a centralized unit database is unavailable (such as when a network connection is unavailable) or undesired.

In certain aspects, it may be desirable to have the local device be aware of which speech synthesis units it can handle to provide a sufficient quality result (such as those units that are locally stored with a number of robust examples), and which units are better handled by a remote TTS device (such as those units that are locally stored with a limited number of examples). For example, if a local unit database includes at least one example of each speech synthesis unit, the local device may not be aware when it should use its locally stored units for synthesis and when it should turn to the remote device. In this aspect, the local device may also be configured with a list of units and their corresponding acoustic features that are available at a remote TTS device and whose audio files should be retrieved from the remote device for speech synthesis.

Using perceptual coding techniques, such as CELP (code excited linear prediction), a local TTS unit database according to one aspect of the present disclosure may be approximately 250 MB in size. Such a unit database may provide sufficiently high quality results without taking up too much storage on a local device.

In one aspect of the present disclosure, unit selection techniques using either the local unit database and/or the centralized unit database may be combined with parametric speech synthesis techniques performed by either the local device and/or a remote device. In such a combined system parametric speech synthesis may be combined with unit selection in a number of ways. In certain aspects, units which are not comprehensively represented in a local unit database may be synthesized using parametric techniques when parametric synthesis may provide adequate results, when network access to a remote unit database is unavailable, when rapid TTS results are desired, etc.

Figure 5:
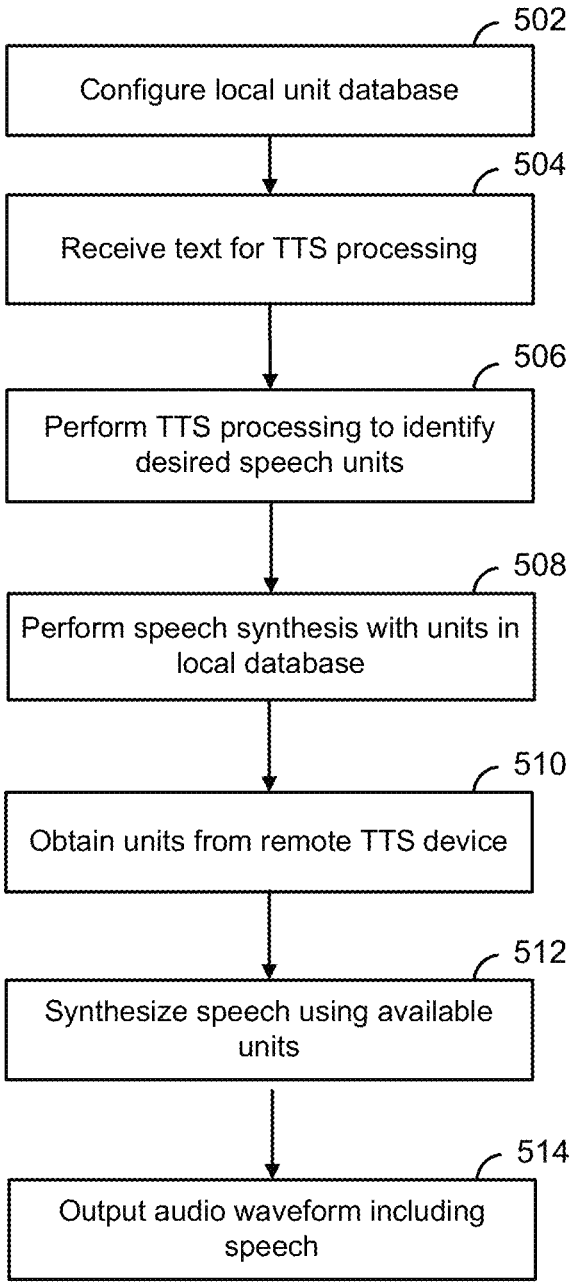
FIG. 5 illustrates performing TTS with a local speech unit inventory according to one aspect of the present disclosure.

In one aspect of the present disclosure, TTS processing may be performed as illustrated in FIG. 5. As shown in block 502, a local unit database for speech synthesis may be configured for a local TTS device. The local unit database may be based on a larger unit database available at a remote device. As shown in block 504, the local device may receive text data for processing into speech. As shown in block 506, the local device may then perform preliminary TTS processing to identify the desired speech units to be used in speech synthesis. As shown in block 508, the local device may then perform speech synthesis using units available in the local unit database. For units which are not available in the local unit database, or for units where other unit examples are desired, the local device may obtain audio segments corresponding to other units from a remote device, as shown in block 510. The local device may then perform speech synthesis using the available unit audio segments, as shown in block 512. As shown in block 514, the local device may then output the audio waveform including speech corresponding to the input text.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A computing device for performing text-to-speech (TTS) processing, comprising:

at least one processor;

a memory device including instructions operable to be executed by the at least one processor to perform a set of actions, configuring the at least one processor:

to access a local database of speech units to be used in unit selection speech synthesis, wherein the local database is comprised from a larger database of speech units;

to receive text data for TTS processing;

to determine desired speech units to synthesize the received text data;

to identify first desired speech units in the local database;

to determine the second desired speech units are not in the local database;

to determine that the second desired speech units are in the larger database located at a remote device;

to receive the second desired speech units;

to concatenate audio segments corresponding to the first desired speech units in the local database and audio segments corresponding to the second desired speech units; and to output audio data comprising speech corresponding to the received text data.

2. The computing device of claim 1, wherein the local unit database is configured based at least in part on a desired TTS result quality, storage configuration of the device, user preference, frequency of use of units in the local unit database, or frequency of TTS activity of the device.

3. The computing device of claim 1, wherein the local unit database is configured based at least in part on a desired level of network or processing activity of the remote device.

4. The computing device of claim 1, wherein identifying the second desired speech units comprises comparing the desired speech units with a list of remotely available speech units.

5. The computing device of claim 1, wherein the local unit database comprises at least one example of each available speech unit.

6. A method comprising:

receiving text data for text-to-speech processing;

determining first desired speech units and second desired speech units from the received text data;

determining that a local database does not include the first desired speech units;

receiving first audio segments corresponding to the first desired speech units from a remote database;

receiving second audio segments corresponding to the second desired speech units from the local database; and creating audio corresponding to the received text data using the first audio segments and the second audio segments.

7. The method of claim 6, further comprising identifying the first audio segments and second audio segments by a local device.

8. The method of claim 6, further comprising identifying the first audio segments and second audio segments by a remote device.

9. The method of claim 6, wherein the local database is comprised from speech units selected from the remote database.

10. The method of claim 6, further comprising reconfiguring the local database after creating the audio.

11. The method of claim 10, wherein the reconfiguring comprises removing speech units from the local database.

12. The method of claim 10, wherein the reconfiguring is based at least in part on a user preference, a network load, a storage configuration of a local device, an application operated by a user, desired inclusion of foreign speech units, and/or desired speech synthesis quality.

13. The method of claim 10, wherein the reconfiguring is based at least in part on a frequency of use of at least one speech unit.

14. A computing device, comprising:

at least one processor;

a memory device including instructions operable to be executed by the at least one processor to perform a set of actions, configuring the at least one processor:

to receive text data for text-to-speech processing;

to determine first desired speech units and second desired speech units from the received text data to determine that a local database does not include the first desired speech units;

to identify the first desired speech units in a remote database for use in synthesizing the received text data;

to identify the second desired speech units in the local database for use in synthesizing the received text data;

to send first audio segments corresponding to the first desired speech units to a local device comprising the local database; and to send instructions to the local device to concatenate the first audio segments with second audio segments corresponding to the second desired speech units stored at the local device.

15. The computing device of claim 14, wherein the local database is comprised from speech units selected from the remote database.

16. The computing device of claim 14, wherein the at least one processor is further configured to reconfigure the local database after performing the concatenation.

17. The computing device of claim 16, wherein the at least one processor is further configured to remove speech units from the local database.

18. The computing device of claim 16, wherein the at least one processor is configured to reconfigure based at least in part on a user preference, a network load, a storage configuration of a local device, an application operated by a user, desired inclusion of foreign speech units, and/or desired speech synthesis quality.

19. The computing device of claim 16, wherein the at least one processor is configured to reconfigure based at least in part on a frequency of use of at least one speech unit.

20. A non-transitory computer-readable storage medium storing processor-executable instructions for controlling a computing device, comprising:

program code to receive text data for text-to-speech processing;

program code to determine first desired speech units and second desired speech units from the received text data;

program code to determine that a local database does not include the first desired speech units;

program code to identify the first desired speech units in a remote database for use in synthesizing the received text data;

program code to identify the second desired speech units in the local database for use in synthesizing the received text data;

program code to send first audio segments corresponding to the first desired speech units to a local device comprising the local database; and program code to send instructions to the local device to concatenate the first audio segments with second audio segments corresponding to the second desired speech units stored at the local device.

21. The non-transitory computer-readable storage medium of claim 20, wherein the local database is comprised from speech units selected from the remote database.

22. The non-transitory computer-readable storage medium of claim 20, further comprising program code to reconfigure the local database after performing the speech synthesis.

23. The non-transitory computer-readable storage medium of claim 22, wherein the program code to reconfigure comprises program code to remove speech units from the local database.

24. The non-transitory computer-readable storage medium of claim 22, wherein the program code to reconfigure is based at least in part on a user preference, a network load, a storage configuration of a local device, an application operated by a user, desired inclusion of foreign speech units, and/or desired speech synthesis quality.

25. The non-transitory computer-readable storage medium of claim 22, wherein the program code to reconfigure is based at least in part on a frequency of use of at least one speech unit.

* * * * *